United States Patent [19]

Lowe et al.

[11] 4,308,736

[45] Jan. 5, 1982

[54] TUBE EXPANDER

[75] Inventors: Jerome R. Lowe, Seymour; Frank P. Russo, Waterbury, both of Conn.

[73] Assignee: J & S Hydraulics, Inc., Milford, Conn.

[21] Appl. No.: 136,980

[22] Filed: Apr. 3, 1980

Related U.S. Application Data

[63] Continuation-in-part of Ser. No. 1,200, Jan. 5, 1979, Pat. No. 4,198,844.

[51] Int. Cl.[3] ..... B21D 41/02

[52] U.S. Cl. ..... 72/36; 72/393

[58] Field of Search ..... 72/35, 36, 32, 393; 92/5R, 13.7

[56] References Cited

U.S. PATENT DOCUMENTS

| | | | |
|---|---|---|---|
| 1,039,948 | 10/1912 | Hunter | 72/393 |
| 2,508,377 | 5/1950 | Doerr | 72/393 |
| 2,605,748 | 8/1952 | Rasoletti | 92/5 R |
| 3,042,121 | 7/1962 | Broetzman et al. | 92/13.7 |
| 3,385,087 | 5/1968 | Huth | 72/393 |
| 3,466,920 | 9/1969 | Parker | 72/393 |
| 4,043,171 | 8/1977 | Brookman | 72/393 |

FOREIGN PATENT DOCUMENTS

| | | | |
|---|---|---|---|
| 2616324 | 10/1977 | Fed. Rep. of Germany | 72/393 |
| 2021695 | 12/1979 | United Kingdom | 92/5 R |

*Primary Examiner*—Lowell A. Larson

*Attorney, Agent, or Firm*—Curtis, Morris & Safford

[57] ABSTRACT

A tube expander for expanding or flaring the ends of automobile exhaust pipes and the like includes a segmented expander die having an arbor slidably received within the expander die segments for expanding the die upon movement of the arbor in a first predetermined direction. A manually operated device initially moves the die relative to the arbor to establish the amount of expansion to be permitted in the die and a separate independent hydraulic mechanism is then operated to move the arbor in the first direction in order to flare the end of a tube placed on the die to increase its diameter by a predetermined dimension. The compact structure provided enables the tool to be manually operated to flare tubes in situ on an automobile.

6 Claims, 5 Drawing Figures

TUBE EXPANDER

This application is a continuation-in-part of U.S. Pat. application Ser. No. 001,200 filed Jan. 5, 1979, now U.S. Pat. No. 4,198,844 granted Apr. 22, 1980.

The present invention relates to tube expanders, and more particularly to a tube expander which can be operated on a bench or by hand for flaring the ends of automobile exhaust pipes or tubes, mufflers and other articles in situ.

In the installation of exhaust systems for automobiles it is often necessary for connecting ends of exhaust pipes, or even the end tubes of mufflers, resonators and other exhaust system elements, to be flared in order to form a mating coupling with an adjacent segment of pipe or tube. (In this application the terms "pipe" and "tube" are used interchangeably). Heretofore the pipes or tubes have been bent and the ends flared on relatively large expensive machine stands such as are available from the Huth Division of Midas-International Corporation. Such stands necessitate the complete removal of a pipe or tube from the automobile in order to flare the pipe or tube ends. For example, when a muffler alone is replaced, it may be necessary to flare the adjacent ends of the exhaust pipe to which it is to be connected. In such cases the pipe or tube had to be removed from the automobile and expanded on the swaging and expanding stands of the prior art. This of course represents an unnecessary expense in labor and time to remove the pipe or tube, and it would be far preferable to be able to expand the pipe or exhaust tube in situ on the automobile.

Our prior invention provided a simplified hand held tube expander used for in situ expansion of tubes and pipes. The present invention provides an expander which can be used both by hand or on a fixed bench.

It is an object of the present invention to provide a tube expander for use in expanding the ends of exhaust tubes in automotive exhaust systems either in situ or on a work bench.

Another object of the present invention is to provide a tube expander arrangement which is relatively simple in operation and durable in use.

A still further object of the present invention is to provide a tube expander arrangement which can expand pipes or tubes of a variety of different diameters by a predetermined extent, with a simple manual adjustment.

A further object of the present invention is to provide a tube expander or swaging device which is manually adjustable and relatively simple to operate.

In accordance with an aspect of the present invention a tube expander is provided in which a generally cylindrical hollow expansion die is used that consists of a plurality of die segments and an arbor received in the die. The die and arbor have cooperating inclined surfaces arranged to expand the die segments when the arbor is moved in a first predetermined direction. In operation of the device the die segments are initially moved manually relative to the arbor to a defined relative starting position which will determine the maximum expansion of the die on operation of the device. After the initial setting of the die a hydraulic mechanism is activated for drawing the arbor from the start position relative to the die for a predetermined stroke in order to flare the tube and increase its diameter by a predetermined dimension.

The above, and other objects, features and advantages of this invention, will be apparent in the following detailed description of an illustrative embodiment thereof, which is to be read in connection with the accompanying drawing, wherein.

Figure 2:
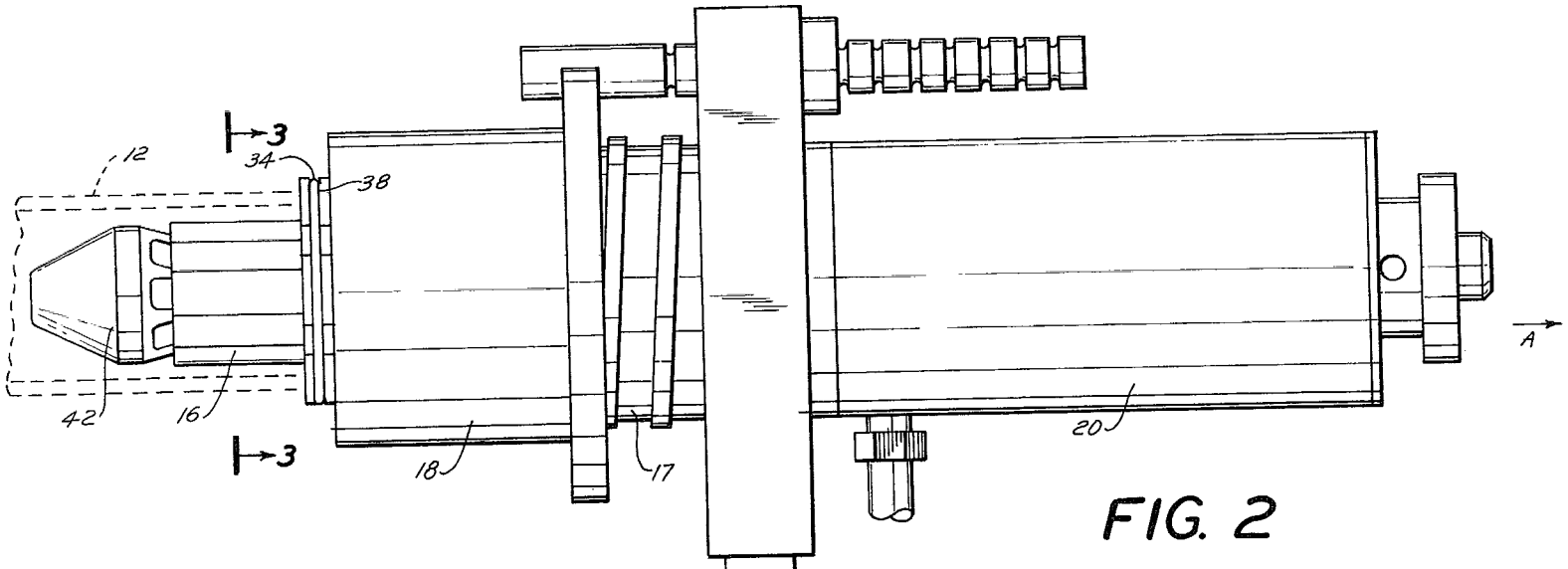
FIG. 2 is an elevational view of the expander shown in FIG. 1.
Figure 1:
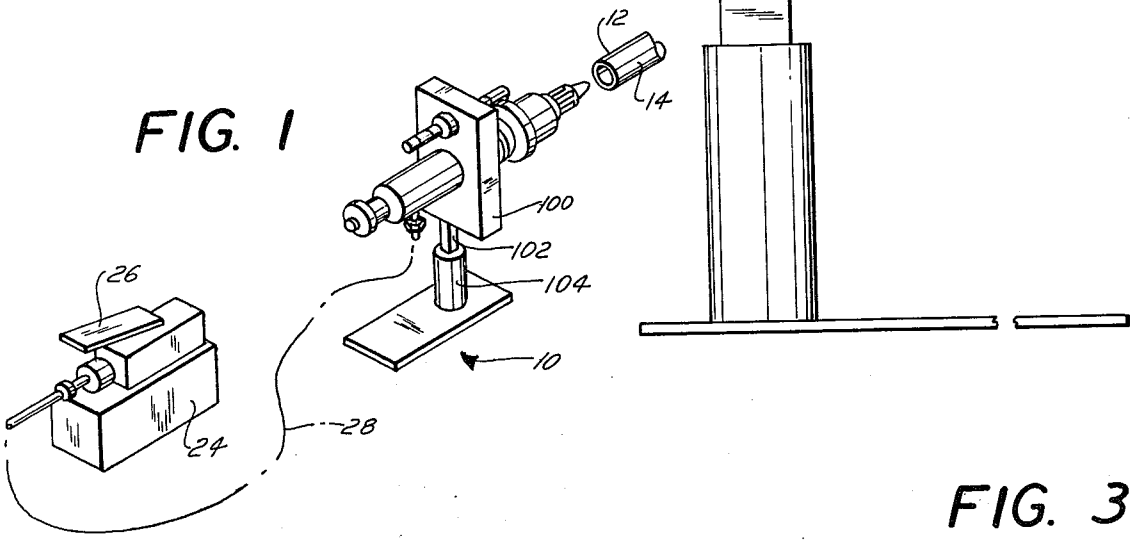
FIG. 1 is a perspective view of a tube expander constructed in accordance with the present invention.

Referring now to the drawing in detail, and initially to FIGS. 1 and 2 thereof, an expander device 10 constructed in accordance with one embodiment of the present invention is shown which is adapted to flare the end 12 of a metal tube 14, such as used in an automotive exhaust system. The expander includes a die 16, casing 17, collar 18 and hydraulic ram 20 that serves to operate die 16 during expansion or swaging of tube end 12. The collar provides a manual adjustment, as described hereinafter, which determines the maximum flaring diameter of the die upon actuation of ram 20.

Expander 10 is controlled by an air-oil pump 24 which is of conventional construction and available as pump number PA 133 from the Enerpac Division of Applied Power Corporation. This pump is connected to a source of shop air (not shown) and when valve 26 is operated oil under pressure is supplied through a flexible tube 28 to ram 20 in order to operate expander die 16, under the influence of high pressure, as described hereinafter.

The die 16 of expander 10 (see FIGS. 2 and 3) consists of a plurality of wedge segments 30 that define a die having a cylindrical outer surface and an octagonally shaped central opening 32. The die segments are retained in their cylindrical configuration by at least one endless coil spring which is received in groove 38 on the outer surfaces of the segments.

An arbor element 42 is received within the octagonal central opening 32 of die 16 formed by segments 30. Arbor 42 has a generally conical configuration with eight relatively flat surfaces formed thereon between eight beveled edges 42'. The flat surfaces of the arbor mate with the flat inner surface portions of segment 30. Upon movement of arbor 42 in the direction of the arrow A in FIG. 2, the wedge segments will be expanded against spring 34 by the engagement of their inner surfaces against flat surfaces of the arbor, as seen in FIG. 3.

Collar 18 engages the rear surfaces of die segments 16 and, as described below when moved to the left, will push the segments with it along arbor 42 to expand the segments. On the other hand, when the collar is moved to the right in FIG. 2 the segments will follow it as they collapse against the arbor under influence of spring 34.

In conventional operation of prior art expanders, the end 12 of tube 14 is simply placed over the die (which is selected to closely match the inner diameter of the tube) and the die is expanded in order to flare the end of the tube. However, with the present invention, the die is initially adjusted manually through a first step in order to establish the maximum expansion diameter of the die after actuation of the ram, then, in a second step, pressurized hydraulic fluid is supplied to ram 20 to operate the ram over a preset stroke in order to flare the tube under pressure to the preestablished maximum flare. This enables the tube expander of the invention to be used with tubes or pipes of a variety of different sizes by means of a simple manual adjustment.

Figure 3:
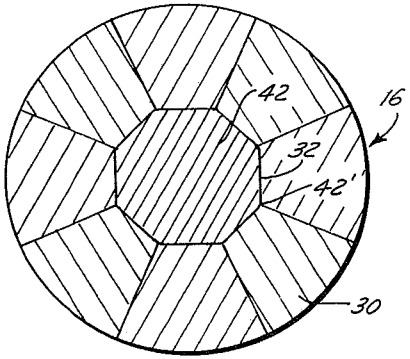
FIG. 3 is a sectional view taken along line 3—3 of FIG. 2.

Referring to FIG. 3, arbor 42 includes a stem portion 46 and a socket portion 48. Socket 48 is received in the bore 50 of the cylindrical aluminum casing 18 which cooperates with socket 48 to guide movement of the arbor in a relatively straight path of travel so that there is little or no wear on the socket and bore or on the cooperating surfaces of the arbor and wedge segments. The outer surface 19 of casing 17 is threaded and cooperates with collar 18 to provide initial adjustment of die 16, as described hereinafter.

Socket 48 is threadably engaged with a threaded rod 54 that extends through hydraulic ram 20 to a free end 56. Ram 20 is also of conventional construction and is a commercially available power element. It includes a casing 58 having inner end 62 which includes an extended portion 64 that is received in a recess or well 66 in collar 18 in order to form a rigid and aligned coupling between the collar and ram. This coupling may be threaded, although that is not necessary. A mere fractional engagement is sufficient.

A piston 68 is provided within casing 58 of ram 20 and includes a hollow generally cylindrical piston rod 70. Preferably, the piston and its integral hollow piston rod 70 are plated in bronze, while casing 58 is formed of steel. The piston rod extends through an opening 72 in the end 74 of the casing and in the at rest position the extreme end 76 of the piston rod is generally aligned with end 74 of the casing. This position of the piston rod is defined by a central stop collar 80 located at the end 64 of casing 58. Piston 68 is biased into this position by a coiled spring 82 contained within the casing between the end 74 thereof and the piston. The piston defines a fluid supply chamber 84 in casing 58 to which hose 28 is connected through a port 86, in any convenient manner.

A nut 88 is threadably engaged on the free end 56 of rod 54 and has a cylindrical extension or collar 90 formed integrally therewith. The nut is turned down on rod 54 so that the end 92 of the sleeve 90 engages the end face 76 of the piston rod through which rod 54 extends. When this is done, the hydraulic ram 20 is held in tight mating engagement in collar 18, between nut 88 and swaging die 16. In this configuration the tube expander is now ready for use.

The expander of the present invention may be operated as either a hand held unit or a bench device. In this regard a support block 100 is secured to casing 17 in any convenient, rigid manner. The block includes an extension 102 which is adapted to be telescopically received in a socket 104 in a bench stand 106, schematically illustrated in FIG. 1. Preferably extension 102 and socket 104 have complementary polygonal configurations to prevent rotation of the expander on the bench during use. In this way the expander can either be supported in the bench by extension 102 or held manually.

Support block 100 has a bushing 106 mounted therein which slidably receives a marker or indicia rod 108. This rod extends parallel to rod 54 and has free end 110 which includes a downwardly opening slot 112 slidably receiving the edge of a flange 114 on collar 18. Rod 108 has a plurality of grooves 116 formed therein which define indicia or marks representative of the maximum flare diameter of the die with the collar set at a position wherein the selected groove aligns with the front face of support block 100.

Figure 4:
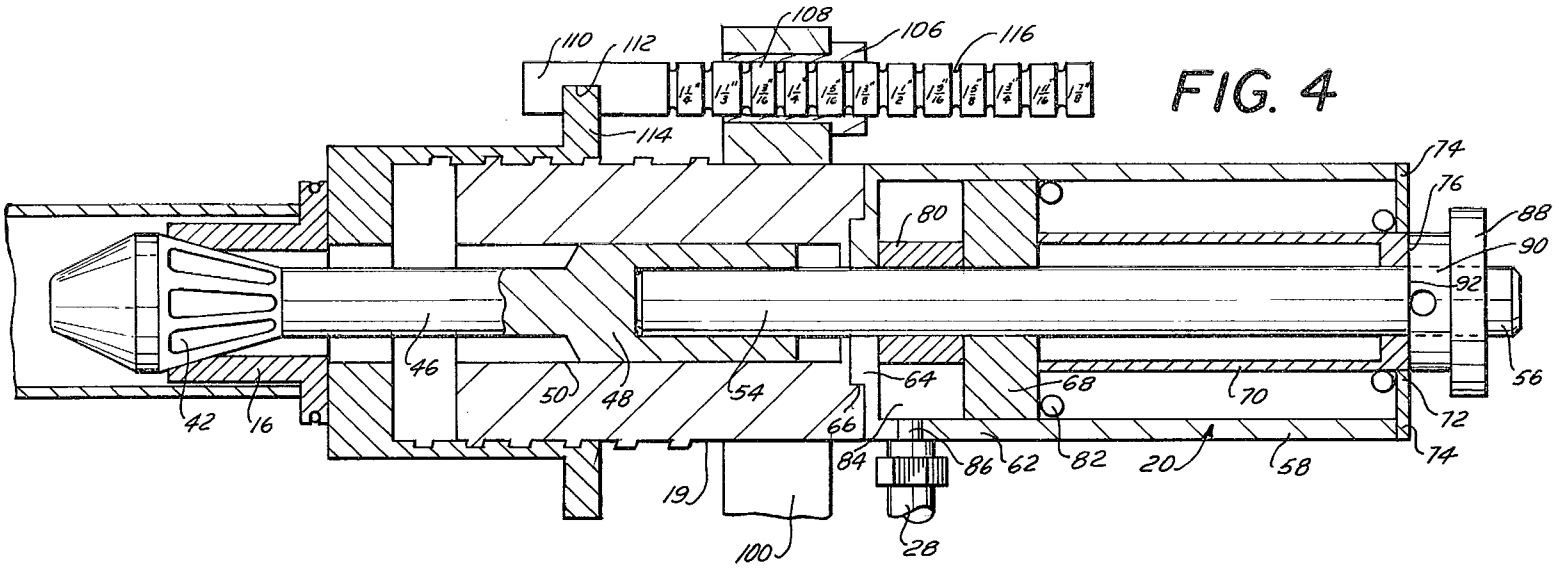
FIG. 4 is a longitudinal sectional view showing the configuration of the elements of the expander upon completion of the manual adjustment of the expander die.
Figure 5:
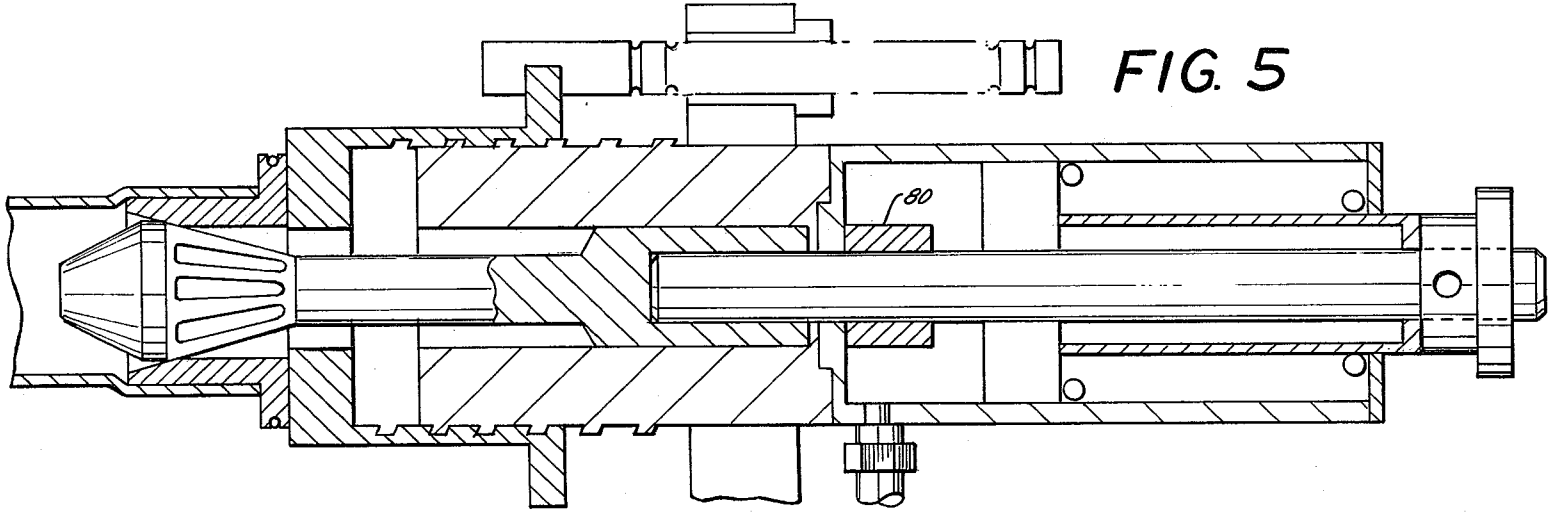
FIG. 5 is a longitudinal sectional view similar to FIG. 4 showing the configuration of the apparatus upon the completion of the application of hydraulic pressure to the expander to expand the tube end.

The first step in use of the apparatus is to determine the flare diameter to be formed in the end 12 of tube 14. When this determination is made collar 18 is rotated to align the proper groove on rod 108 with the face of block 100. Movement of collar 18 causes relative movement of die 16 with respect to arbor 42 and effectively varies the overall length of the casing of the device. Since flange 114 can slide in groove 112 the rod 108 will move longitudinally with the collar. Movement of the die relative to the arbor will cause the die segments to expand (if the collar moves to the left) or retract (if the collar moves to the right) under the influence of spring 34. The location of grooves 116 are related to the dimensions of collar 18, die segments 16 and arbor 42 such that when a groove aligns with the front face of block 100 movement of arbor 42 relative to the die for a predetermined stroke will cause the die to expand to the diameter marked on the rod, i.e. one and one-eighth inches, as shown in FIG. 4. Once the operator has adjusted collar 18 to the starting point necessary to achieve the desired maximum flare, the flaring operation can be performed. The operator then simply actuates valve 26, either by hand or with his foot, in the known manner, so that hydraulic fluid under pressure is supplied through tube 28 to chamber 84, urging piston 68 to the right in FIG. 5. This movement of the piston pushes nut 88 further to the right and thus pulls rod 54 in the same direction, drawing arbor 42 with it. Movement of the arbor further expands the die segments, flaring the end of the tube.

The actual stroke length of the arbor is limited by the engagement of the end 120 of socket 48 against the inner wall 122 of casing 19. The distance between them at the start of the flaring operation is fixed by the length of the rod and adjustment of nut 88. Thus the starting and final flare diameter of the die is determined by its initial position relative to the arbor as controlled by collar 18. Once the flaring operation is completed application of pressure to the ram is relieved by releasing valve 26. Release of the hydraulic pressure permits piston 68 to return to its initial position under the bias of spring 82, pushing rod 54 and arbor 42 towards the left, causing the expanded die to collapse under the influence of the spring 34. This permits the die to be removed from the tube end. The elements of the device are now all in their original starting position and subsequent tubes can be expanded with the device with repeatable accuracy.

By the construction of the present invention a lightweight tube expander tool is provided which is relatively easy to assemble and disassemble. Its light weight makes the tool convenient for manual use in in situ expansion operations, although it may also be used on a bench. As the arbor travels only about one half of an inch under pressure to complete the flaring operation there is little or no wear. The adjustment of the die relative to the arbor to set the final flare diameter is manual and under little or no pressure so that essentially no wear occurs in that portion of the operation.

Although a specific type of hydraulic ram has been described herein with reference to the presently preferred embodiment of the invention, it is contemplated that other types of power supplies can be connected to shaft 54 in order to move the arbor during the power portion of the flaring operation. For example, a double acting ram could be utilized, or air rams rather than hydraulic rams could also be used.

Although an illustrative embodiment of the present invention has been described herein with reference to the accompanying drawings it is to be understood that various other changes and modifications may be effected therein by one skilled in the art without departing from the scope or spirit of this invention.

What is claimed is:

1. A tube expander comprising a segmented expander, an arbor slidably received in said expander for expanding the expander upon movement of the arbor in a first predetermined direction, first means for moving said segmented expander relative to the arbor to establish the amount of expansion of the expander to be permitted, and second means, independent of said first means, for moving said arbor in said first direction to flare a tube end inserted on said segmented expander; said first means comprising a housing having a threaded outer surface and a collar threadedly engaged with said housing and having an outer end engaged with said segmented expander, said arbor being slidably mounted in said housing and extending through said collar; said collar having an inner end including a radially extending flange; at least one marked rod slidably receiving said flange to permit rotation of said flange relative to the rod while moving the rod axially therewith; said rod extending parallel to said arbor and adjacent to a predetermined marker on the housing; said rod having indicia thereon for providing a visual indication of the amount of expansion of the arbor at a given position of the collar on the housing.

2. A tube expander as defined in claim 1 including a support block mounted on the housing and receiving said marked rod, said support block defining said marker.

3. A tube expander as defined in claim 2 wherein said support block includes means for removably mounting the block and arbor on a fixed bench and for providing a handhold to permit hand held operation of said expander.

4. A tube expander as defined in claim 2 wherein said second means comprises a threaded rod secured at one end to said arbor, a hydraulic ram located on the side of said housing opposite said collar, said rod extending through said ram and being operatively engaged therewith for drawing said arbor through said segments upon actuation of the ram.

5. A tube expander as defined in claim 4 wherein said hydraulic ram includes a casing and a hollow piston rod including an integral piston in said casing, said piston rod extending through said casing and said threaded rod extending through said casing and piston rod, a nut on the end of the rod opposite said arbor engaged with said piston rod, and means for supplying fluid under pressure to said casing at least on the side of the piston away from said nut.

6. A tube expander as defined in claim 5 including spring means in said casing engaged between the casing and the piston on the side of the piston facing the nut.

* * * * *